US009995462B2

(12) United States Patent
Nankil

(10) Patent No.: US 9,995,462 B2
(45) **Date of Patent: *Jun. 12, 2018**

(54) CIRCULAR LED OPTIC AND HEAT SINK MODULE

(71) Applicant: Hubbell Incorporated, Shelton, CT (US)

(72) Inventor: Robert R. Nankil, Buena Park, CA (US)

(73) Assignee: Hubbell Incorporated, Shelton, CT (US)

( * ) Notice: Subject to any disclaimer, the term of this patent is extended or adjusted under 35 U.S.C. 154(b) by 85 days.

This patent is subject to a terminal disclaimer.

(21) Appl. No.: 14/719,381

(22) Filed: May 22, 2015

(65) Prior Publication Data

US 2015/0252985 A1 Sep. 10, 2015

Related U.S. Application Data

(63) Continuation of application No. 13/748,714, filed on Jan. 24, 2013, now Pat. No. 9,109,787.

(Continued)

(51) Int. Cl.
*F21V 14/02* (2006.01)
*F21V 21/14* (2006.01)

(Continued)

(52) U.S. Cl.
CPC ..... *F21V 14/02* (2013.01); *F21K 9/20* (2016.08); *F21K 9/65* (2016.08); *F21S 8/08* (2013.01);

(Continued)

(58) Field of Classification Search
CPC ..... F21V 14/02; F21V 29/74; F21V 29/78; F21V 5/02; F21V 5/04; F21V 5/08; F21V 11/08; F21V 14/06; F21V 21/14; F21V 23/06; F21V 21/26; F21V 21/30; F21K 9/20; F21K 9/65; F21S 8/08; F21Y 2105/10; F21Y 2115/10
See application file for complete search history.

(56) References Cited

U.S. PATENT DOCUMENTS

D470,965 S 2/2003 Landefeld
D482,481 S 11/2003 Landefeld (Continued)

OTHER PUBLICATIONS

Philips Wide-Lite Brochure, 2011.

*Primary Examiner* — Bao Q Truong
(74) *Attorney, Agent, or Firm* — Michael Best & Friedrich, LLP

(57) ABSTRACT

An LED module includes a circular body member for mounting in a lighting assembly or luminaire that can be oriented in an opening in the luminaire by rotating the module about a center axis to a predetermined position to direct the light in a selected pattern. A mounting assembly captures the LED modules between top and bottom mounting members. The LED modules include a heat conducting body coupled to the mounting assembly to conduct heat away from the LED and PCB. A top side of the LED body cooperates with the mounting assembly. A bottom side of the LED body has a cavity supporting a PCB with a plurality of LEDs. A lens body is coupled to the bottom side of the body of the LED module to direct the light to the target area.

28 Claims, 11 Drawing Sheets

Related U.S. Application Data

(60) Provisional application No. 61/590,584, filed on Jan. 25, 2012.

(51) Int. Cl.

| | |
|---|---|
| ***F21V 5/04*** | (2006.01) |
| ***F21S 8/08*** | (2006.01) |
| ***F21V 29/74*** | (2015.01) |
| ***F21V 29/78*** | (2015.01) |
| ***F21V 5/02*** | (2006.01) |
| ***F21V 5/08*** | (2006.01) |
| ***F21V 11/08*** | (2006.01) |
| ***F21V 14/06*** | (2006.01) |
| ***F21V 23/06*** | (2006.01) |
| ***F21K 9/20*** | (2016.01) |
| ***F21K 9/65*** | (2016.01) |
| *F21V 21/26* | (2006.01) |
| *F21V 21/30* | (2006.01) |
| *F21Y 105/10* | (2016.01) |
| *F21Y 115/10* | (2016.01) |

(52) U.S. Cl.

CPC ..... *F21V 5/02* (2013.01); *F21V 5/04* (2013.01); *F21V 5/08* (2013.01); *F21V 11/08* (2013.01); *F21V 14/06* (2013.01); *F21V 21/14* (2013.01); *F21V 23/06* (2013.01); *F21V 29/74* (2015.01); *F21V 29/78* (2015.01); *F21V 21/26* (2013.01); *F21V 21/30* (2013.01); *F21Y 2105/10* (2016.08); *F21Y 2115/10* (2016.08)

(56) References Cited

U.S. PATENT DOCUMENTS

| | | | | |
|---|---|---|---|---|
| 7,488,097 | B2 | 2/2009 | Reisenauer et al. | |
| 7,997,768 | B2 | 8/2011 | Zheng | |
| 8,061,868 | B2 | 11/2011 | Dubord | |
| 8,075,163 | B2 | 12/2011 | Xiao et al. | |
| 9,109,787 | B2 * | 8/2015 | Nankil | F21V 21/14 |
| 2008/0080188 | A1 | 4/2008 | Wang | |
| 2008/0080190 | A1 * | 4/2008 | Walczak | F21V 14/02 362/294 |
| 2009/0323330 | A1 | 12/2009 | Gordin et al. | |
| 2010/0103668 | A1 | 4/2010 | Lueken et al. | |
| 2010/0110671 | A1 | 5/2010 | Gordin et al. | |
| 2010/0157594 | A1 * | 6/2010 | Yang | F21K 9/23 362/235 |
| 2011/0044038 | A1 | 2/2011 | Mo | |
| 2011/0122632 | A1 | 5/2011 | Ku et al. | |
| 2011/0194279 | A1 | 8/2011 | Kuo | |
| 2011/0291588 | A1 | 12/2011 | Tagare | |
| 2012/0014099 | A1 | 1/2012 | An et al. | |
| 2012/0025711 | A1 | 2/2012 | Best et al. | |
| 2012/0217897 | A1 | 8/2012 | Gordin et al. | |
| 2012/0307486 | A1 * | 12/2012 | Gordin | F21S 4/00 362/223 |

* cited by examiner

CIRCULAR LED OPTIC AND HEAT SINK MODULE

CROSS-REFERENCE TO RELATED APPLICATION

This application claims priority under 35 U.S.C. § 119(e) to U.S. Provisional Patent Application Ser. No. 61/590,584, filed Jan. 25, 2012, which is hereby incorporated by reference in its entirety.

FIELD OF THE INVENTION

The present invention is directed to an LED module assembly and to a luminaire having an array of the LED module assemblies. The invention is also directed to an LED module having a heat sink for mounting in a luminaire where each of the LED modules in the luminaire are positionable about a center axis to orient each LED module and direct light in a direction independently of each other.

BACKGROUND OF THE INVENTION

In recent years, commercial and residential lighting applications include an array of LED chips or assemblies as the light source in place of the conventional incandescent lights or HID lights.

LEDs are more efficient forms of lights than conventional light sources although LEDs are known to have various problems and concerns. LEDs can be difficult to focus and direct the light to a selected area. LEDs emit light in all directions from the circuit board and require a lens or prism to control the direction and distribution of the light. Individual LEDs do not provide sufficient light so that large numbers or arrays of LEDs are required to illuminate the desired area.

LEDs also require a mechanism for dissipating the heat that is inherently produced by the LED. Various structures are proposed for use with LED arrays that include heat sinks, cooling fins, and the like, to dissipate the heat and prevent damage to the LED and circuit board.

U.S. Patent Publication No. 2012/0025711 to Best et al. discloses an outdoor overhead lamp assembly having a plurality of LED modules within the lamp. The modules are mounted to inclined surfaces for directing the light in a selected direction. The inclined surfaces are molded into the housing of the luminaire so that the position of the LED modules is fixed.

U.S. Patent Publication No. 2012/0014099 to An et al. discloses a lighting system having a plurality of LED modules mounted to a base and a heat sink extending outwardly from the base as shown in FIG. 4.

U.S. Patent Publication No. 2011/0291588 to Tagare discloses a light fixture having an array of self-contained LED tiles. The tiles have geometric shapes for joining the LEDs together in selected patterns.

U.S. Patent Publication No. 2011/0194279 to Kuo discloses an LED lighting device. The lighting device includes a housing and a circuit board supporting LED lamps. A cover is mounted to the housing to retain the LED modules in the housing.

U.S. Patent Publication No. 2011/0122632 to Ku et al. discloses an LED unit having a lens. The lens has an incidence surface, an emission surface and a light-reflecting face between the incidence surface and the emission surface.

U.S. Patent Publication No. 2011/0044038 to Mo discloses an LED lamp having a plurality of LEDs mounted in a supporting plate. The LEDs include first LEDs disposed on a top surface of the supporting plate and a plurality of second LEDs disposed on the bottom surface of the supporting plate and surrounding a light reflecting member.

U.S. Patent Publication No. 2010/0157594 to Yang et al. discloses an LED lamp having a semi-spherical lamp body and a plurality of LEDs embedded on an outer surface of the semi-spherical body.

U.S. Patent Publication No. 2010/0103668 to Leuken et al. and assigned to Hubbell discloses an LED with a plurality of luminaire modules. The luminaire modules in this device are mounted in a fixed position.

U.S. Patent Publication No. 2008/0080188 to Wang discloses a modular assembly for an LED lamp. The LED modules have an LED mounted to a base which is attached to a heat sink as shown in FIG. 2.

U.S. Pat. No. 8,075,163 to Xiao et al. discloses an illumination lamp and rotatable light emitting module. The module as shown in FIGS. 2 and 3 include an LED array mounted to a base plate. The base plate is pivotally mounted to a support so that the orientation of the array can be adjusted with respect to the housing.

U.S. Pat. No. 8,061,868 to Dubord discloses an adjustable LED lighting system. The lighting system includes an LED array mounted to a printed circuit board as shown in FIG. 2. The housing surrounding the LED includes a cylindrical housing that can be broken in two pieces along a tear line that extends diagonally through the cylindrical housing. The top portion of the housing can be rotated with respect to the bottom portion and snap fit together to angle the lens in a selected direction as shown in FIG. 6.

U.S. Pat. No. 7,997,768 to Zheng discloses an LED lamp having an upper base plate and a lower base plate with a plurality of LED modules between the plates. Each module has a heat sink sandwiched between the two base plates and a lens engaging the bottom surface of a conductive cylinder enclosing the LED module.

U.S. Pat. No. 7,488,097 to Reisenauer et al. discloses an LED lamp module designed to be retrofitted into an existing incandescent light fixture. The module includes a circular metal core with an LED and printed circuit board. A second surface of the metal core is configured to contact a fixture and heat generated by the LED conducted to the fixture.

While the prior lighting devices are generally suitable for their intended purpose, there is a continuing need in the industry for improved LED lighting devices.

SUMMARY OF THE INVENTION

The present invention is directed to an LED module and to a luminaire that includes a plurality of the LED modules. The invention is particularly directed to a luminaire having a plurality of LED modules where the position of each LED module is independently adjustable with respect to the luminaire to direct the light from each LED module in a selected direction to direct a selected light pattern to a target area to be illuminated.

The luminaire of the invention has a housing with an array of LED modules for directing light to a selected target area. Each of the LED modules can be oriented independently in the lighting assembly with respect to the housing to direct light in a predetermined direction. The lighting assembly includes a housing that enables the LED modules to be positioned for directing light from the LEDs in a selected direction and pattern.

Accordingly, one object of the invention is to provide an LED module and to provide a luminaire adapted to receive an array of the LED modules. The LED modules can conduct heat from the LEDs to a heat sink within the luminaire housing. Each of the LED modules have a heat conducting body that can conduct heat to a primary heat sink in the luminaire.

A further feature of the invention is to provide an LED optic module having a substantially circular shape that is adapted for mounting in an array within a luminaire or lighting assembly and being rotatable within the luminaire or lighting assembly to direct light to a predetermined area and light pattern.

Another feature of the invention is to provide an LED module having a plurality of LEDs for illuminating the target area.

A further feature of the invention is to provide an LED module having a plurality of LEDs that are angled in a predetermined direction at an incline with respect to a plane of the module and the housing. A plurality of the LED modules are mounted in an array on the housing. The LED modules are mounted in the housing in selected positions to aim the LEDs to direct light to a selected target area.

The LED module has a substantially circular shaped body. The circular body is mounted to a support structure in a luminaire where the module can be rotated about an axis perpendicular to the plane of the support and the LED module to direct the light to a selected area. The LED modules are rotatably positioned independently in the desired location with respect to a center axis of the respective module and then fixed to prevent movement after installation.

The LED module in one embodiment of the invention is a cast metal body with an open bottom and a plurality of fins extending from a top end. The bottom of the body has a cavity with a supporting surface for a printed circuit board supporting at least one, and preferably at least two LEDs. The printed circuit board can be attached to the supporting surface by a thermally transmissive adhesive or grease. The printed circuit board is mounted to the mounting surface in a manner to conduct heat from the LEDs to the cast metal body where the heat can be dissipated away from the LEDs. In one embodiment, the printed circuit board and LEDs are fixed to the body and are not movable with respect to the body.

In one embodiment, the LED modules are coupled to a mounting assembly within the luminaire housing such that the heat from the LEDs is conducted through the module to the mounting assembly. In one embodiment, the luminaire housing can include air vents to enable cooling of the LED modules and the mounting assembly.

The cavity in the bottom side of the LED module body has a depth to receive the PCB and LED assembly and to aim the LEDs in a selected direction with respect to the module. In one embodiment of the invention, the PCB is mounted to direct the light from the LEDs at an inclined angle of about 60° with respect to a horizontal plane of the module. The PCB includes wires that extend to a male connector and to a female connector for connecting the PCB and LEDs to a power source. In one embodiment, the female connector is attached to a top face of the LED module. The male connector extends from a wire having a length to connect to a female connector of an adjacent LED module to connect a plurality of the LED modules in series.

The LED module includes a molded cover forming a lens body that is attached to the bottom side of the body of the module. Preferably, the cover is made of a clear plastic such as an acrylic resin. The cover has a circular configuration to conform to the shape of the body and fit within the recess in the bottom of the body. The cover has an upwardly projecting upper portion to conform to the shape of the cavity formed in the bottom of the body, a downwardly projecting lower portion and a lens portion extending between the upper and lower portions. The lens portion is parallel to the PCB and spaced from the LEDs a suitable distance to focus and direct light from the LEDs to the target area in a line substantially perpendicular to the plane of a mounting surface of the module. In the embodiment shown, the lens and LEDs are angled to project the light at an incline with respect to the plane of the module.

The LED modules are mounted in a mounting assembly of the luminaire. The bottom face of the luminaire housing has a plurality of openings for mounting an LED module assembly. The LED module assembly is captured between a top plate and bottom plate and coupled to the luminaire housing to position the LED assembly within the opening of the housing. In one embodiment, the bottom plate has an outwardly extending top flange, an inwardly extending bottom flange and a cylindrical side wall extending between the top flange and the bottom flange to define a recess. The bottom flange has an opening for supporting the LED module and directing light from the LED module through the opening in the luminaire housing. A flat, planar shade having a gasket around the perimeter is seated in a recess around the opening of the luminaire housing. The top plate is positioned onto the bottom plate to capture the LED module. Screws can extend through holes in the top plate and the outwardly extending flange of the bottom plate and onto threaded holes in the top face of the luminaire housing to couple the assembly.

A further feature of the invention is to provide a luminaire module with alignment studs or projections on the top face for mating with a corresponding recess in the bottom face of the top plate of the support. The LED module in one embodiment has a central portion that mates with a recess or hole formed in a center of the top plate. A plurality of registration holes or recesses are provided in the top plate around the center recess for mating with the alignment stud. The LED module can be rotated about a vertical axis extending through the center of the module to allow the alignment stud to register with a selected second recess to position the LED module in a selected position to aim the LEDs with respect to the luminaire.

The features of the invention are basically attained by providing an LED module comprising a body member made from a heat conducting material. The body has a top side and a bottom side and a plurality of heat conducting fins extending from the top side. The bottom side has a mounting surface. The mounting surface is inclined with respect to a plane of the bottom side of the body. A PCB is coupled to the inclined mounting surface. The PCB has at least one LED for directing light at an incline with respect to the plane of the bottom side.

The features of the invention are also attained by providing a luminaire comprising a housing having a support assembly and a plurality of LED modules coupled to said support surface. Each of the LED modules are independently positionable with respect to the support surface of the luminaire to direct light in a selected target area with respect to a respective LED module. Each LED module comprises a heat conducting body member coupled to the housing. The body member has a top side with a plurality of heat conducting fins and a bottom side having a mounting surface. The mounting surface is oriented at an incline with respect to a plane of the bottom side. A PCB is coupled to the inclined mounting surface and has at least one LED mounted on the PCB for directing light to the selected target area at an incline with respect to a plane of the body member and with respect to a plane of the support assembly of the luminaire.

The features of the invention are further attained by providing a luminaire including a housing with a support assembly and a plurality of LED modules coupled to the support surface to direct light to a selected area with respect to a respective LED module. Each LED module has a heat conducting body member coupled to the housing. The body member has a top surface with heat conducting fins and a bottom side with an inclined LED mounting surface. The mounting surface is oriented at an incline with respect to a plane of the bottom side. A PCB is coupled to the inclined mounting surface. The PCB has at least one LED mounted thereon for directing to the target area at an incline with respect to a plane of the body member and the support assembly.

The features of the invention are also attained by providing a luminaire having a housing with a bottom wall and a plurality of LED modules adapted for directing light to a target area. Each LED module has a body member coupled to the bottom wall of the housing and has at least one LED for directing light at an incline with respect to a plane of the bottom wall. The LED module has a central axis perpendicular to the plane of the bottom wall and is rotatably adjustable with respect to the central axis independent of each other LED module to direct light from each LED module to a selected location of the target area.

These and other aspects of the invention will become apparent from the following detailed description of the invention, which taken in conjunction with the annexed drawings, disclose various embodiments of the invention.

BRIEF DESCRIPTION OF THE DRAWINGS

The drawings illustrate various embodiments and features of the invention, in which.

DETAILED DESCRIPTION OF THE INVENTION

Figure 1:
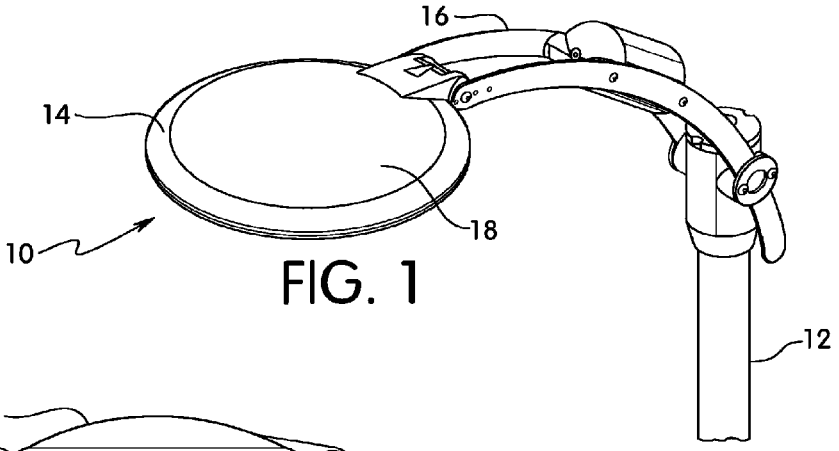
FIG. 1 is a top perspective view of the luminaire in one embodiment of the invention.
Figure 2:
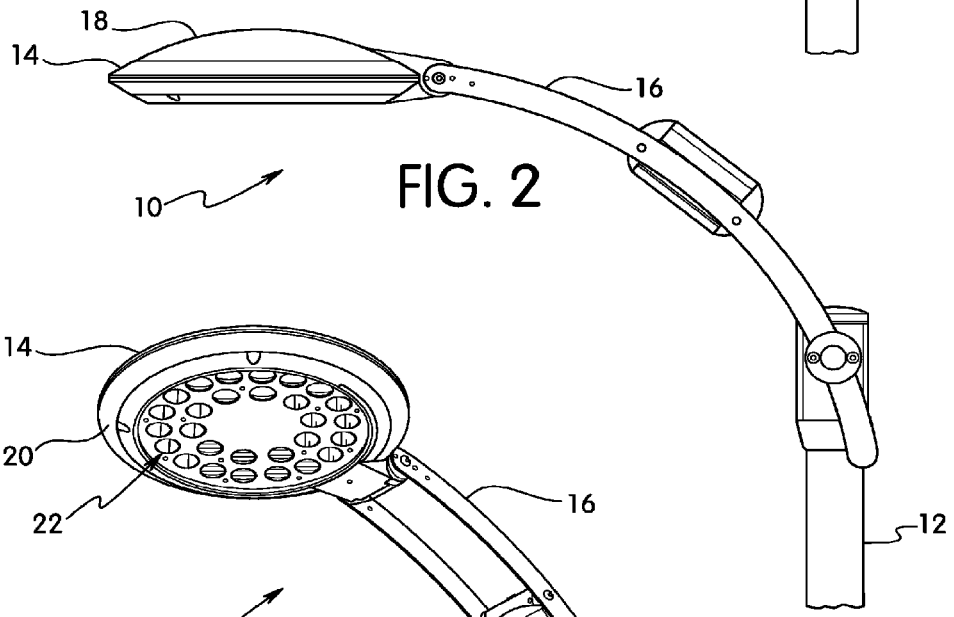
FIG. 2 is a side view of the luminaire of FIG. 1.
Figure 3:
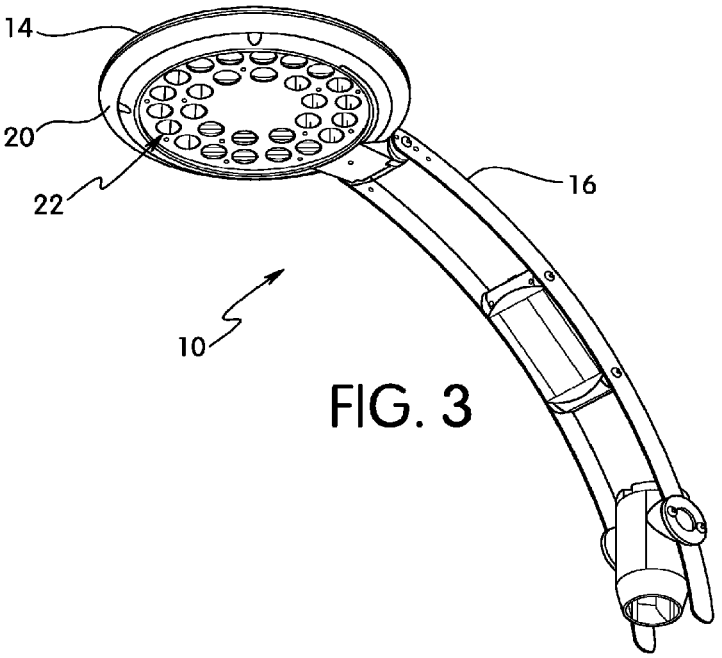
FIG. 3 is a bottom perspective view of the luminaire.

The present invention is directed to a luminaire or lighting assembly having a plurality of LED modules and to an LED optic and heat sink module adapted for mounting in a luminaire. The invention is further directed to a luminaire having a plurality of LED modules that can be independently positioned within the luminaire to direct the light from each of the LED modules in a selected direction and to direct light from an array of the LED modules in a predetermined pattern in a target area to be illuminated.

Referring to the drawings, the invention in one embodiment is directed to a lighting assembly shown as luminaire assembly 10 for mounting to a pole 12 or other support. The luminaire 10 includes a housing 14 and a mounting bracket 16 for coupling the luminaire 10 to the pole 12. The housing 14 has a generally low profile configuration with a top surface 18 and a bottom surface 20. The bottom surface 20 includes an LED array 22 for directing light in a generally downward direction in a predetermined pattern. The luminaire or lighting assembly can be in any suitable shape or form depending on the intended use.

Figure 4:
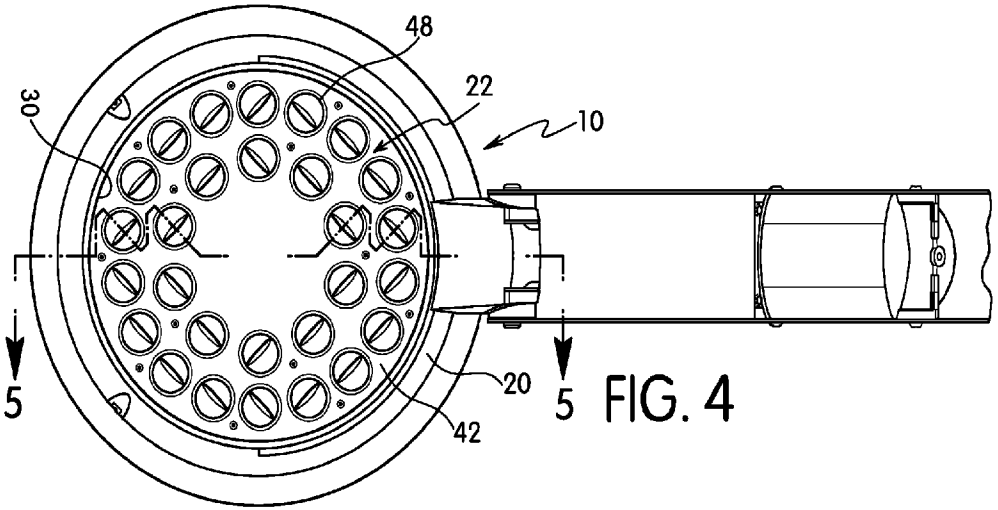
FIG. 4 is a bottom view of the luminaire.
Figure 5:
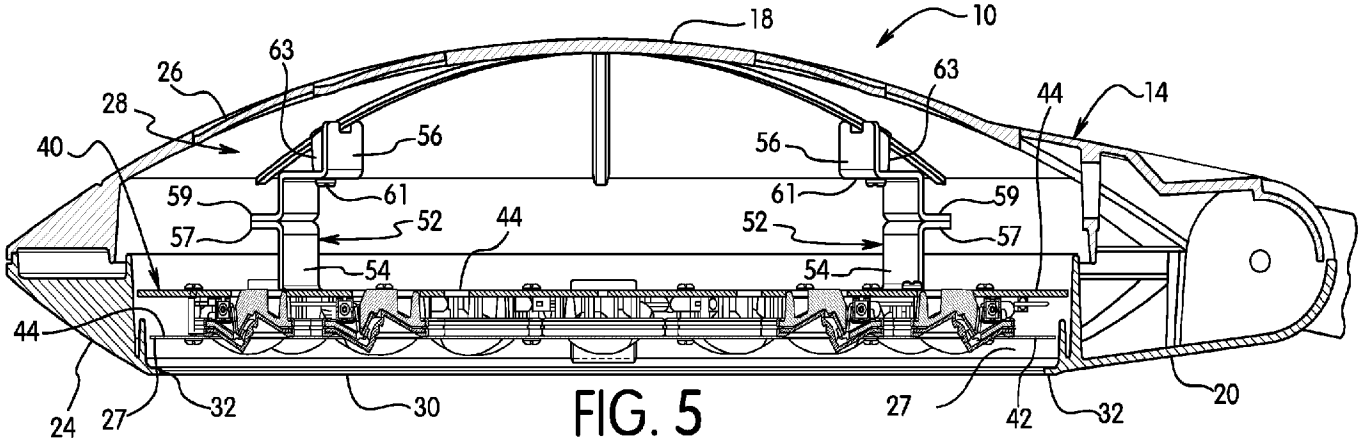
FIG. 5 is a cross-sectional of the luminaire taken along line 5-5 of FIG. 4.

Referring to FIGS. 4 and 5, the housing 14 has a bottom wall 24 and a top wall 26 forming a cavity 28 between the bottom wall 24 and top wall 26. The bottom wall 24 includes a central opening 30 for the LED array 22 and directing the light from the LED array in a generally downward direction through the opening in the housing. In the embodiment shown, the opening 30 has a circular configuration defined by a lip 32. The top wall 26 is coupled to the bottom wall 24 by various fasteners.

Figure 6:
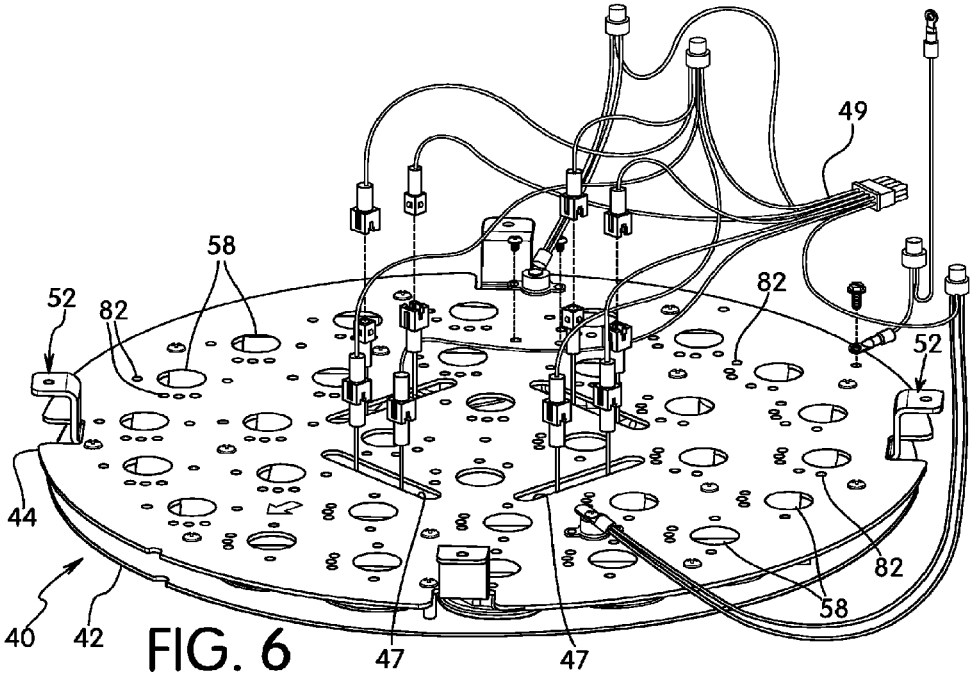
FIG. 6 is a top perspective view of the mounting assembly for the LED modules of the invention.
Figure 7:
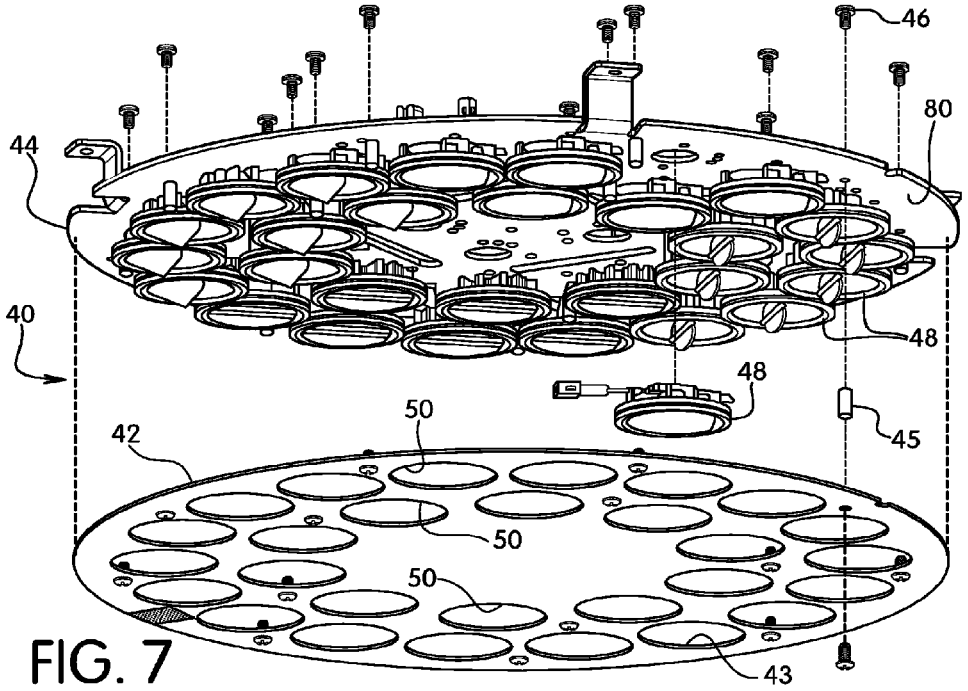
FIG. 7 is an exploded view of the mounting assembly of FIG. 6.
Figure 8:
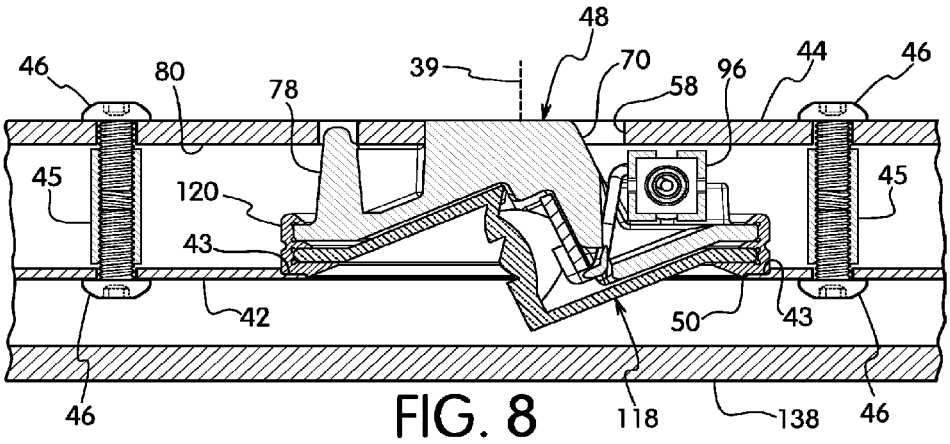
FIG. 8 is a cross-sectional side view of the LED module and mounting assembly.

The LED array 22 includes a mounting assembly 40 shown in FIGS. 5-7 coupled to the housing 14 to position and support the LED array within the housing to project light through opening 30 in the housing 14. The mounting assembly 40 includes a base 42 and a top plate 44. As shown in FIGS. 6-8, the base 42 and top plate 44 are coupled together by screws 46. In the embodiment shown, a screw 46 passes through a respective hole in the base 42 and the top plate 44 and are threaded into a threaded sleeve 45 positioned between base 42 and top plate 44.

The LED array is made up of a plurality of LED modules 48 positioned between the base 42 and top plate 44 of the mounting assembly 40 which defines a support for the LED modules 48. The base 42 includes a plurality of circular openings 50 for receiving a respective LED module 48. The openings 50 are spaced apart in a predetermined pattern to orient each of the LED modules in a manner to provide a predetermined lighting pattern.

In the embodiment illustrated, 28 LED modules are provided in the LED array. The number and arrangement of the openings 50 for the LED modules can vary depending on the intended use of the luminaire. The arrangement of the openings 50 and LED modules 48 as shown are intended to be exemplary.

Referring to FIG. 6, the top plate 44 of the mounting assembly 40 includes a plurality of spaced apart openings 58 aligned with each of the openings 50 in the base 42. The openings 58 in the top plate 44 receive the top end of the respective LED module 48. As shown in FIG. 8, the LED modules 48 are captured between the base 42 and top plate 44 of the mounting assembly 40 and are rotatable about a vertical axis 39 extending through the axial center of the openings 50 in the base 42 and the openings 58 in the top plate 44.

Referring to FIGS. 6 and 7, top plate 44 has a plurality of elongated openings 47 for feeding wiring from a wiring harness 49 from a suitable power source (not shown) to the LED modules 48. Top plate 44 is coupled to the top wall 26 of the housing 14 to position the mounting assembly 40 and the LED array in the opening 30 of the housing 14. Alternatively, the mounting assembly can be attached to other parts of the housing. In the embodiment shown in FIG. 5, the top plate 44 has a bracket 52 extending between the top wall 26 of the housing 14 and the top plate 44 of the mounting assembly. The bracket 52 has a first section 54 coupled to the top plate 44 and a second section 56 coupled to the top wall 26 of the housing 14. Each section 54 and 56 has a substantially L-shape with mating leg portions 57 and 59, respectively. The leg portions are coupled together by a clip or screw passing through the leg portions. The second section 56 is attached to the top wall 26 by a bolt 61 threaded into a boss 63 formed in the top wall 26.

In the embodiment shown, the mounting assembly 40 is suspended from the top wall 26 of the housing 14 and is spaced a small distance from the bottom wall 24 to form a gap 27 between the mounting assembly 40 and the housing 14 around the central opening 30. The gap 27 allows sufficient air circulation through the housing to maintain the LEDs at a suitable temperature.

Referring to FIGS. 9-15, the LED modules 48 have a circular configuration for mounting within and cooperating with the opening 50 in the base 42 and the opening 58 in the top plate 44. In one embodiment, the LED modules 48 are supported by the base 42 with the outer edge seated in a circular recess surrounding the opening 50 with a portion of the module 48 extending through the opening. In the embodiments of the invention, each of the LED modules 48 are substantially identical and can be individually oriented within the respective opening 50 by rotating and adjusting the position of the LED module 48 within the opening 50 along the center axis 39 of the opening 50. Each of the LED modules 48 can be adjusted to direct the light in a selected direction to provide a predetermined pattern of the light directed to a target area. By rotating the orientation of the LED modules 48 within the opening 50, the angular direction of the LEDs and the light can be selected for each LED module independently to modify light pattern from the LED array.

Figure 9:
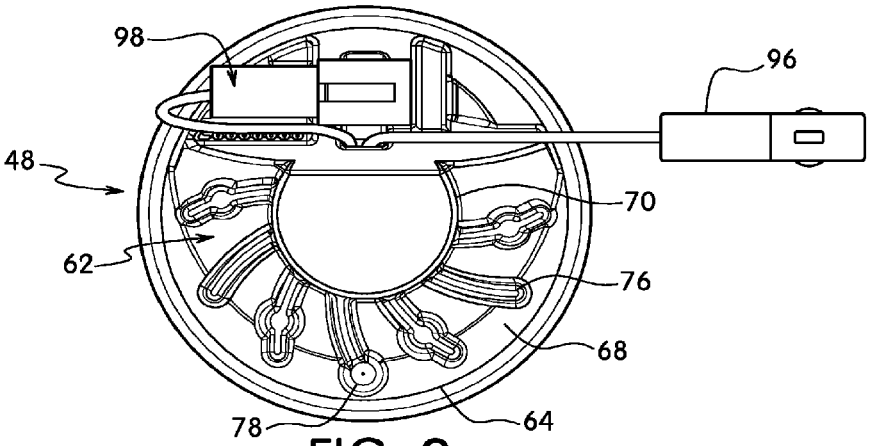
FIG. 9 is a top view of the LED module in one embodiment of the invention.
Figure 10:
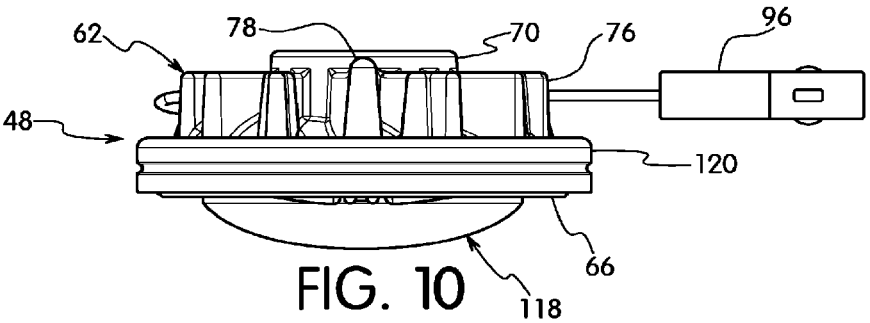
FIG. 10 is a front view of the LED module of FIG. 9.
Figure 11:
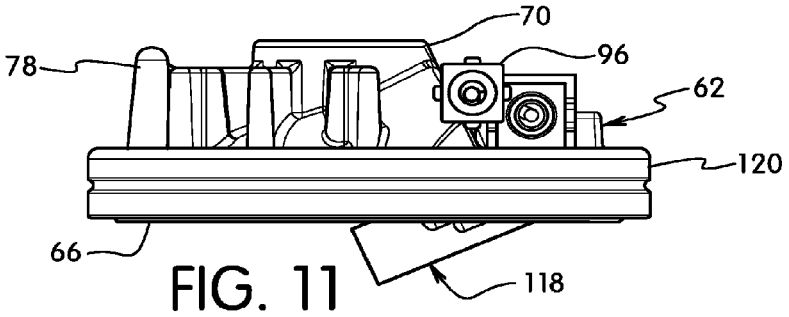
FIG. 11 is a side view of the LED module.
Figure 12:
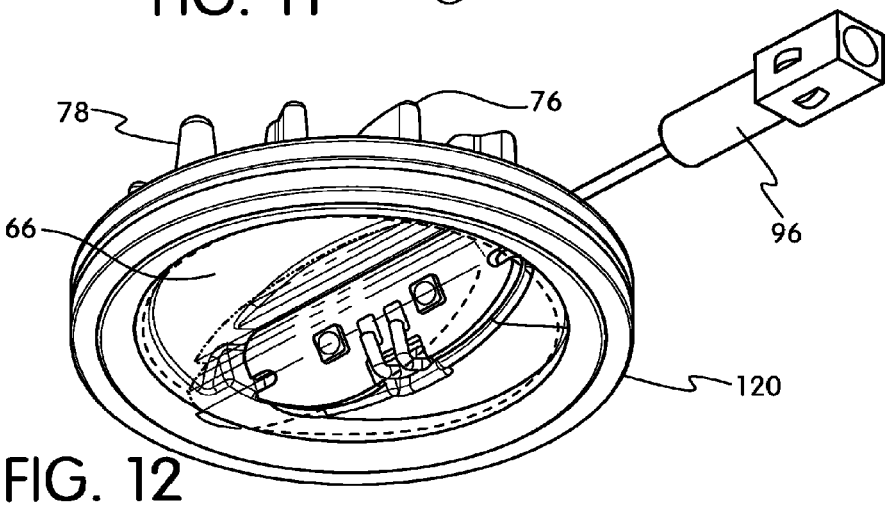
FIG. 12 is a bottom perspective view of the LED module.
Figure 13:
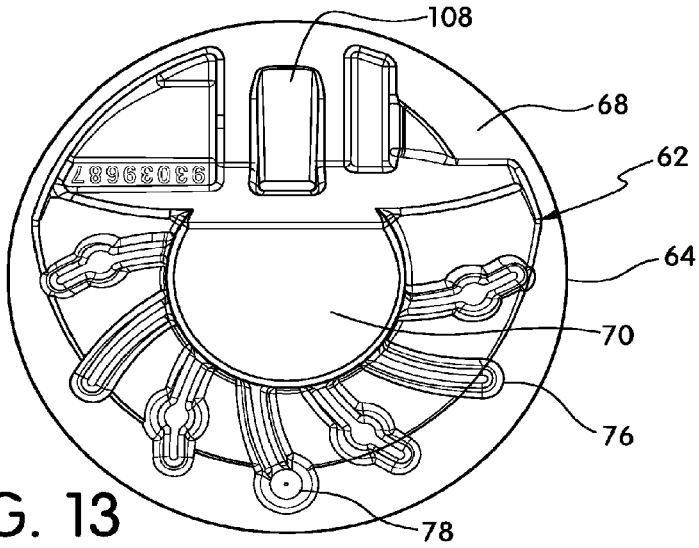
FIG. 13 is a top view of the LED module of FIG. 9 with the wiring removed.
Figure 15:
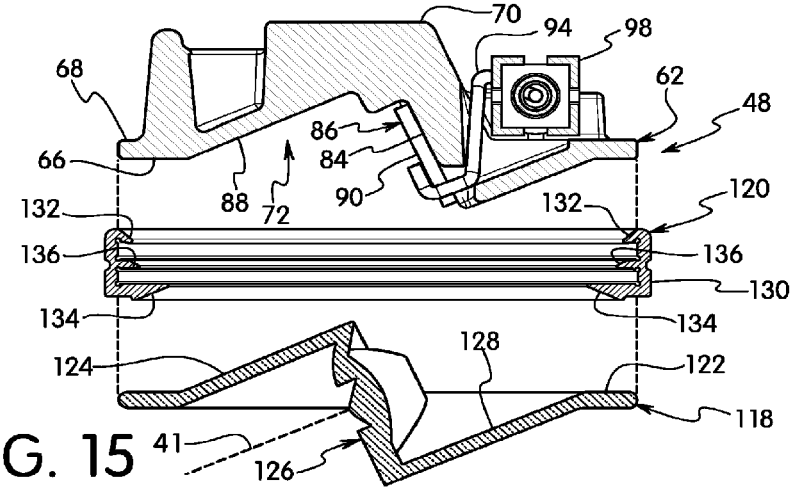
FIG. 15 is an exploded cross-sectional view of the LED module of FIG. 9.

The LED modules 48 include a body 62 that can be made of a suitable material such as metal or other heat conducting material. The base 42 and the top plate 44 can also be made of metal or other heat conducting material. The mounting assembly for the LED modules can function as a primary heat sink for the LED modules. The LED module 48 has a circular configuration with an outer edge 64 shown in FIG. 9, a bottom face 66 and a top face 68. A central hub 70 extends upwardly from the top face 68 as shown in FIG. 15. A recess 72 is provided in the bottom face 66 shown in FIG. 15. The center hub 70 mates with and rotates within the respective aperture 58 in the top plate 44 of the mounting assembly 40. A plurality of cooling fins 76 extend radially outward from the central hub 70 and upwardly from the top face of the module. As shown in FIG. 9, the fins 76 have a generally curved, spiral shape extending radially outward toward the outer edge 64. A registration pin 78 extends upwardly from the top face 68 adjacent the outer edge 64 as shown in FIG. 10. The body 62 in the embodiment shown is a one-piece member.

The bottom face 80 of the top plate 44 of the mounting assembly 40 includes at least one and preferably a plurality of registration recesses or holes 82 for receiving the registration pin 78 as shown in FIG. 8. The registration pin 78 is received in a respective registration opening 82 to orient the angular position of the LED module 48 about its vertical central axis 39 in the luminaire. Preferably, the registration openings 82 are provided in a predetermined pattern to position the LED modules in a predetermined orientation based on the selected registration opening 82. As shown in FIG. 6, the registration openings 82 are arranged in a generally semi-circular pattern around the openings 58, although other patterns can be used.

The recess 72 in the body 62 has a substantially flat inclined mounting surface 84 for supporting an LED assembly 86. The mounting surface 84 is formed at an incline with respect to the center axis 39 of the body 82 and at an incline with respect to the bottom face 66 and top face 68. In the embodiment illustrated, the mounting surface 84 is oriented at an angle of about 60° with respect to the bottom face 66 and the transverse axis of the body 62. The recess 72 also includes an arcuate concave shaped surface 88 extending at an incline with respect to the transverse plane of the module and substantially perpendicular to the plane of the mounting surface 84. The concave shaped surface 88 extends from the mounting surface 84 towards the outer edge 64 at an angle to direct light at an inclined angle with respect to a transverse plane of the module 48.

The LED assembly 86 includes a printed circuit board (PCB) 90 supporting at least one and preferably two juxtaposed LEDs 92. More than two LEDs can be used depending on the lighting requirements. The LEDs 92 are mounted to the printed circuit board in a conventional manner and are connected to a power source by wires 94 coupled to the printed circuit board 90.

In one embodiment of the invention, the LED assembly 86 is fixed to the inclined mounting surface 84 by a suitable adhesive that is preferably heat conducting to transfer the heat from the LEDs and PCB to the body 62 of the LED module 48. Typically, the LED assembly is in a fixed position and not movable with respect to the LED module so that light from the LEDs is directed along a fixed principal axis 41 with respect to the body 62. The angular orientation of the LED module is selected to direct the light in a selected direction around the center axis 39 of the LED module.

Figure 14:
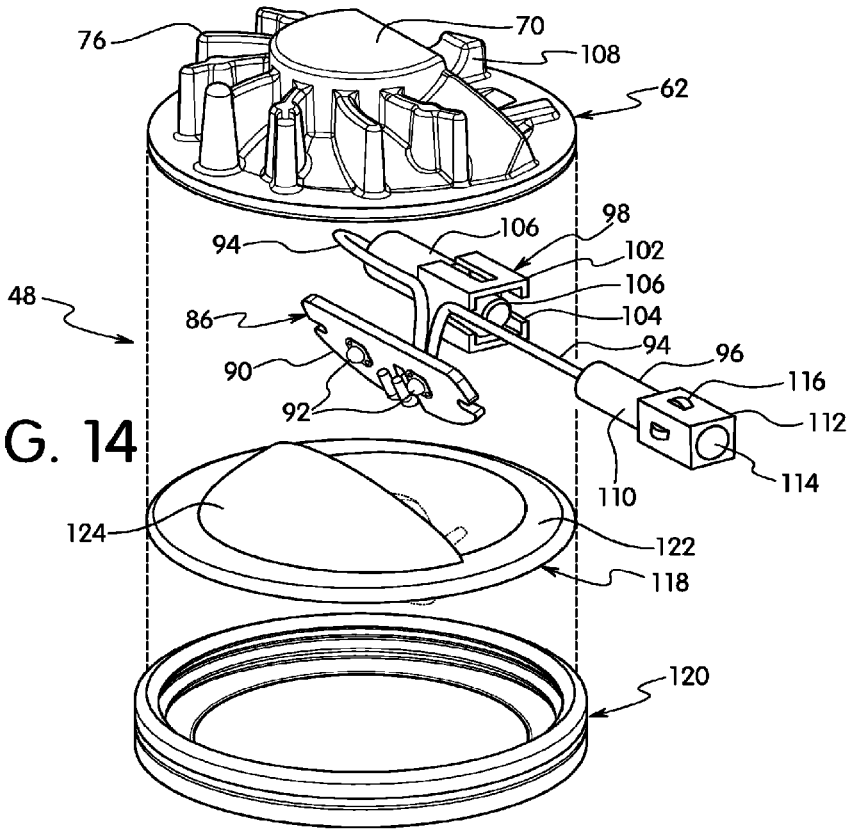
FIG. 14 is an exploded perspective view of the LED module of FIG. 9.

The wires 94 extend to a female coupling member 96 and a male coupling member 98 as shown in FIG. 14. The coupling member 98 includes an electrical connector 100 and a sleeve 102 having a plurality of coupling apertures 104 and a cylindrical body 106. In one embodiment, the cylindrical body 106 is mounted to the top face 68 of the body 62. In a preferred embodiment, the top face 68 of the body 62 is provided with a U-shaped recess 108 for receiving the cylindrical body 106 as shown in FIG. 8. The cylindrical body 106 of the coupling 98 is typically attached to the recess 108 by a suitable adhesive. The coupling 96 has a cylindrical body 110 with a square end 112 having an axial hole 114 and outwardly extending detents 116 for mating with a coupling 98 of an adjacent LED module. In this manner, each of the LED modules are connected together in series by the respective couplings 96 and 98 to form the LED array. The LED array is coupled to a suitable power source by the wiring harness 49. In the embodiment shown, the wiring harness 49 includes a connector or plug that connects to the power source for operating the LEDs.

A cover or lens body 118 is coupled to the bottom face 66 of the body 62 by a ring 120. Ring 120 can be made from a flexible polymeric material having a suitable shape for attaching the lens body 118 to the body 62 by fitting over the outer edges of the body 62 and the lens body 118 as shown in FIG. 8. The lens body 118 has a top surface with a shape to conform to the shape of the recess 72 in the bottom face of the body 62. The lens body 118 has an outer edge 122, a convex arcuate portion 124 complementing the shape of the concave arcuate surface 88, light transmitting portion in the form of a lens 126 and a convex arcuate portion 128 extending downwardly from the cover 118. The lens 126 is oriented substantially parallel to the mounting surface 84 and the LED assembly 86 to direct light from the LED assembly along a principal axis shown in FIG. 8 at a fixed inclined angle with respect to the plane of the module and housing.

Figure 16:
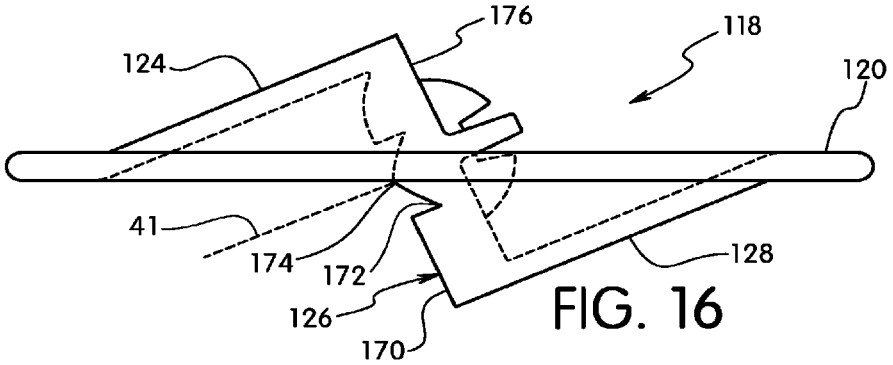
FIG. 16 is a side view of the lens cover.
Figure 17:
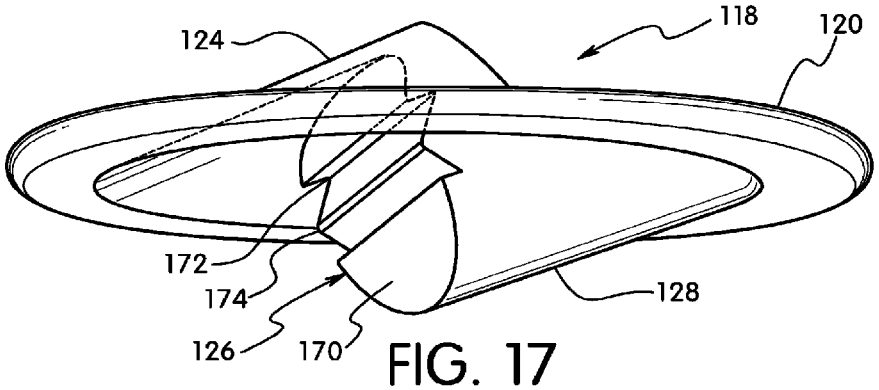
FIG. 17 is a bottom perspective view of the lens cover.
Figure 18:
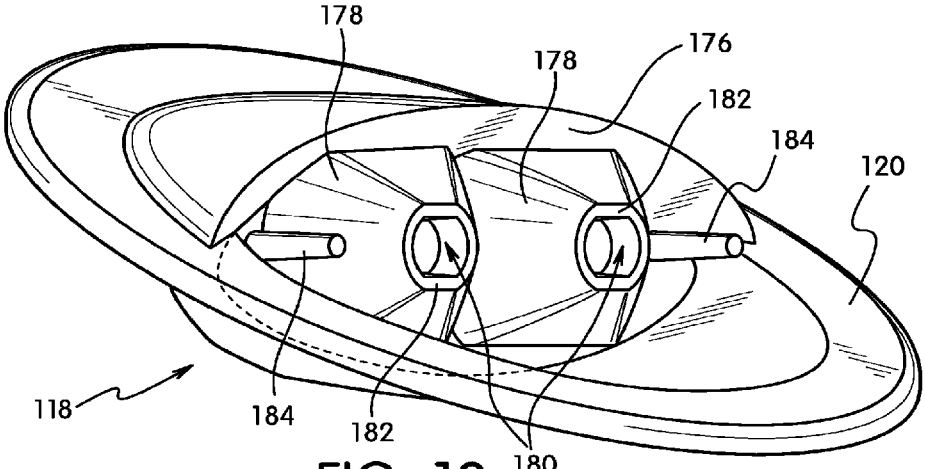
FIG. 18 is a top perspective view of the lens cover.

Referring to FIGS. 16-20, the details of the lens body 118 are shown. The lens body 118 is formed as a one piece unit and is made of a transparent plastic material suitable for forming a lens and focusing light to the target area. The lens 126 is formed by a planar outer face 170 extending between the convex portion 124 and the convex portion 128. As shown in FIG. 16, the outer face 170 has a recess 172 forming a substantially V-shaped prism 174 extending the width of the planar outer face 170. The shape of the prism 174 is shown as a single prism although a plurality of prisms or lenses can be provided.

Figure 19:
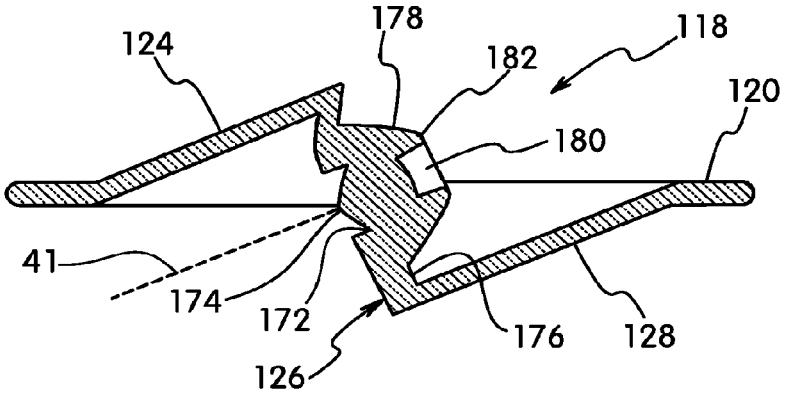
FIG. 19 is a cross-sectional view of the lens cover of FIG. 16.
Figure 20:
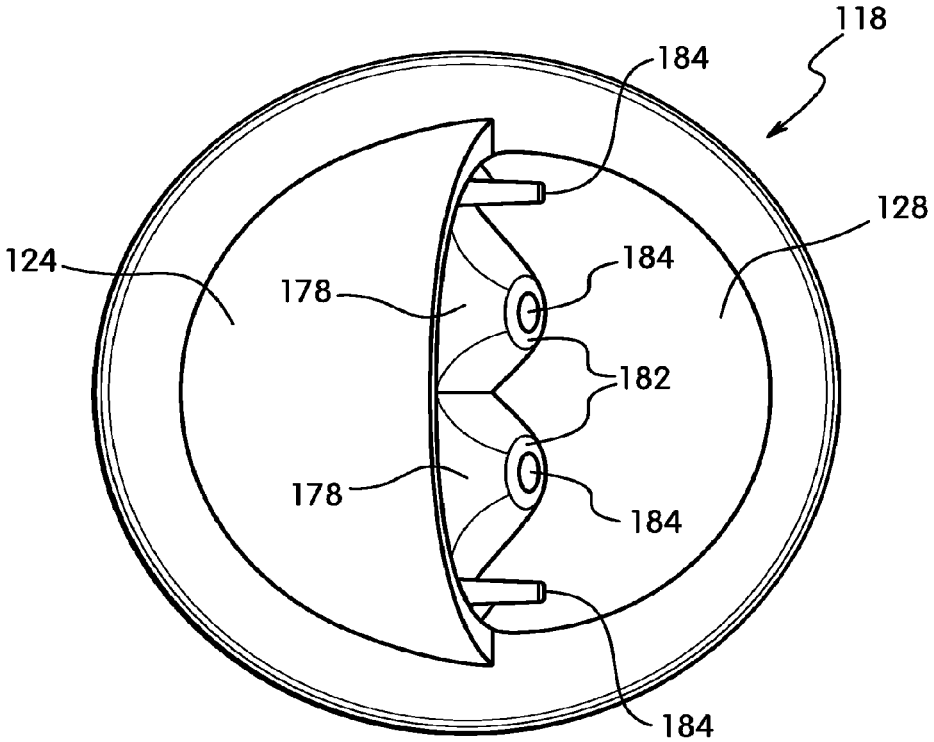
FIG. 20 is a top view of the lens cover.
Figure 21:
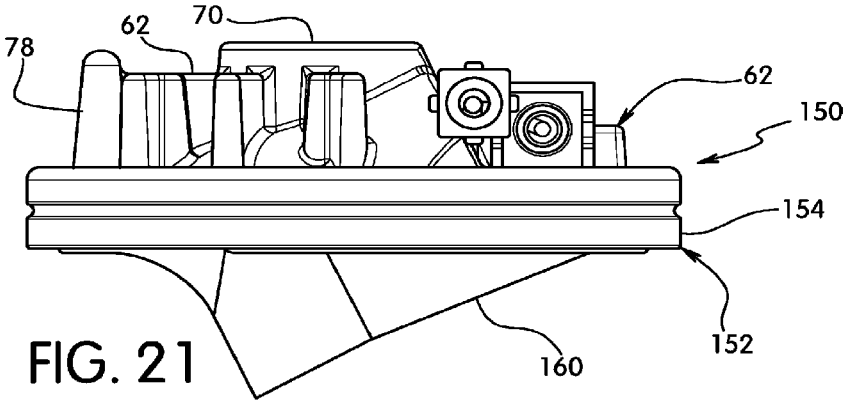
FIG. 21 is a side view of the LED module in a second embodiment showing the modified shade.
Figure 22:
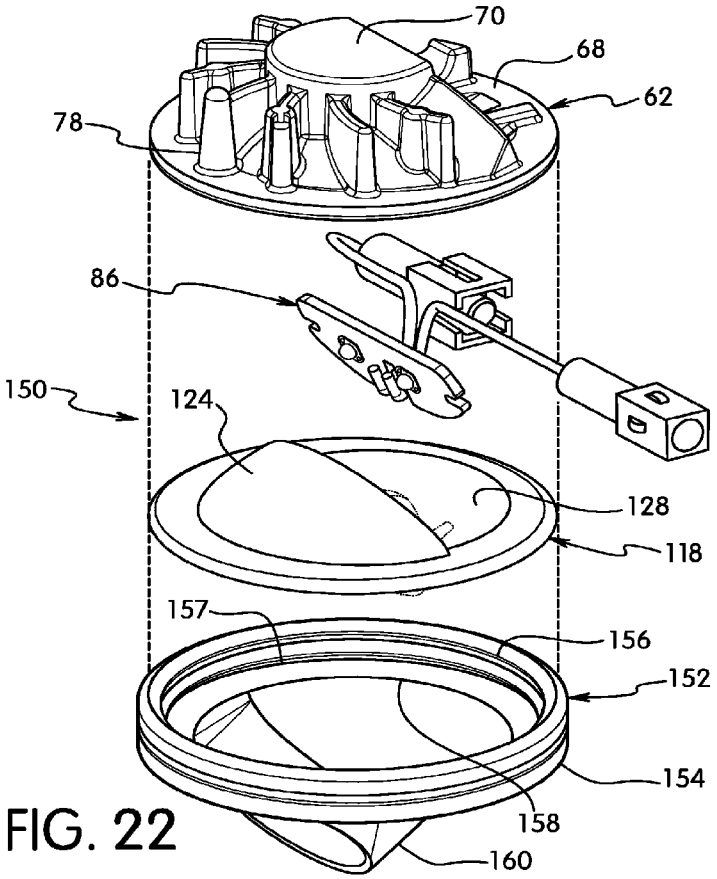
FIG. 22 is an exploded perspective view of the LED module of FIG. 21.
Figure 23:
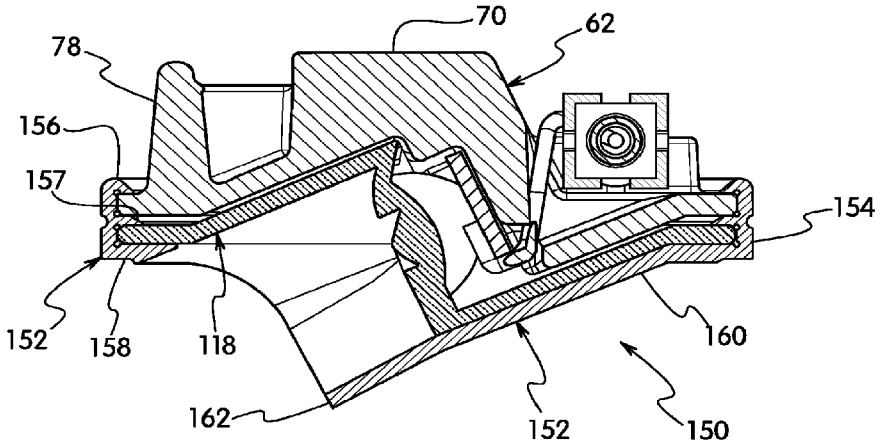
FIG. 23 is a cross-sectional side view of the LED module of FIG. 21.
Figure 24:
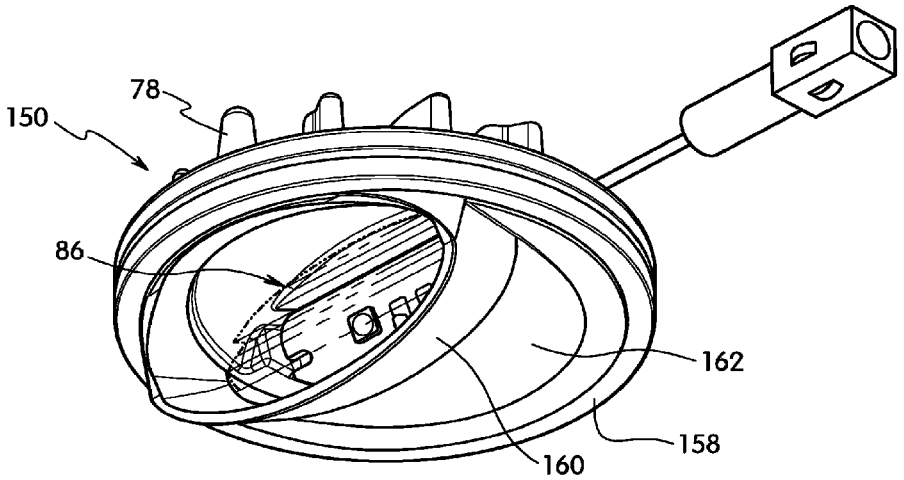
FIG. 24 is a bottom view of the LED module of FIG. 21.
Figure 25:
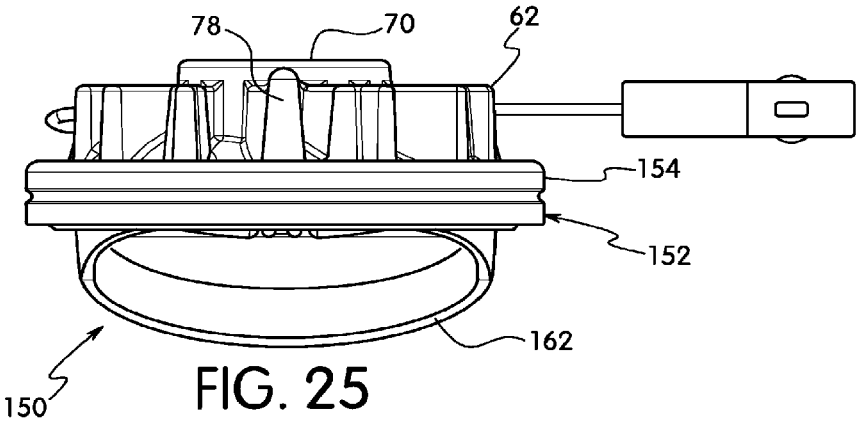
FIG. 25 is an end view of the LED module of FIG. 21.
Figure 26:
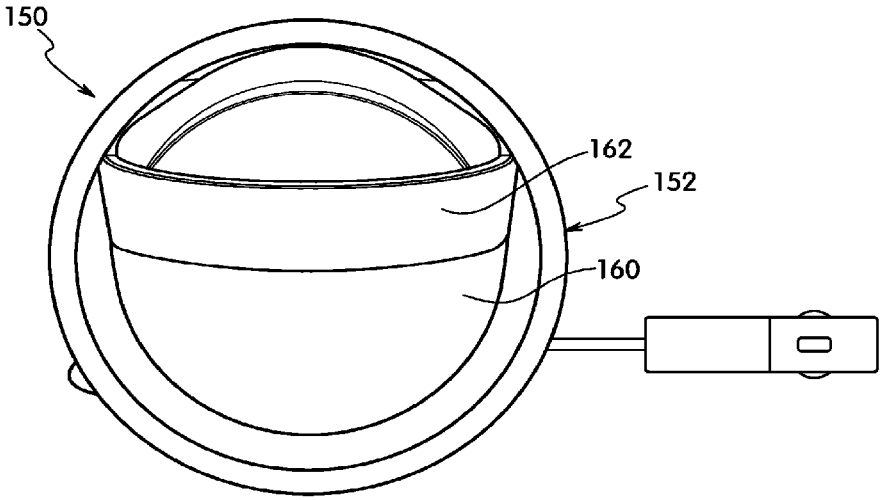
FIG. 26 is a bottom view of the LED module of FIG. 21.

Referring to FIGS. 19 and 20, the rear, inner face 176 of the lens 126 includes two adjacent frustoconical portions 178 with a central recess 180. The recesses 180 are oriented to align with the two LEDs 92. In a preferred embodiment, the perimeter of each recess 180 has a substantially planar surface 182 to mate with the PCB 90 with the LED 92 projecting into and received in the respective passage 180. The frustoconical portions 178 define a body within the lens with reflective surfaces in the recesses 180 for directing light from the LEDs 92 through the lens 126 and to the target area. A pair of mounting posts 184 are provided for attaching the lens body 118 to the module body 62.

The lens 126 is adapted for directing light from the LED module in a direction substantially perpendicular to the plane of the mounting surface 84 and the LED assembly 86. The ring 120 which can be in the form of a gasket has an annular shape for encircling the outer edge of the body 62 and the lens body 118. The ring 120 includes a radial outer face 130, an upper lip 132 and a lower lip 134 forming grooves receiving the outer edges of the body 62 and the lens body 118 as shown in FIG. 8. An inwardly extending spacer 136 separates the body 62 and the lens body 118. As shown in FIG. 8, the ring 120 couples the lens body 118 to the body 62 to form the LED module 48.

As shown in FIG. 8, each of the LED modules 48 is mounted in the respective opening 50 in the base 42 and is captured between the base 42 and the top plate 44. The LED modules 48 is supported by a rim 43 around the respective opening 50 with a portion of the module or the lens body 118 extending through the opening. The upwardly extending end of the body 62 is received within the respective aperture 58. The position of the LED module 48 is selected according to the registration opening 82. Each LED module 48 is rotated about the center axis 39 of the body 62 to align the registration pin 78 with the selected registration opening 82. The LED modules 48 are constructed to project light from the LED assembly at an incline along the axis 41 with respect to the center axis 39 of the module 48 and the bottom face 66 of the body 62. The angular orientation of the respective LED modules 48 with respect to the mounting assembly 40 and the luminaire enables the light from the respective LED module to be directed in a selected direction to distribute the light to the target area in a selected pattern. As shown in FIG. 4, each of the LED modules 48 is oriented independently of the other LED modules. In one embodiment, registration openings 82 are provided in the top plate spaced apart approximately 90° from each other to enable orientation of the LED module in one of several orientations. The arrangement and location of the registration recesses 82 can vary depending on the luminaire and the intended use. As shown in FIG. 4, the LED modules can be oriented to project the light from the respective LED module in different directions, thereby creating a predetermined lighting pattern.

In the embodiment illustrated, the luminaire 10 is adapted for mounting to the pole 12 with the LED array oriented in a plane substantially parallel to the ground surface and target area to be illuminated. In the embodiment shown, a protective lens or prism 138 is coupled to the central opening 30 of the bottom wall 24 and is spaced from the LED modules 48. The lens 138 can be transparent or have a suitable surface to provide the desired diffusion of the light from the LED modules. In other embodiments, the lens 138 can be omitted.

Referring to FIGS. 21-26, a second embodiment of the invention is shown. The luminaire includes an LED module 150 similar to the LED module 48 of the previous embodiment so that the same elements will be identified by the same reference number. The LED module includes a body 62 and a lens cover 118 that are substantially identical to the previous embodiment. A ring 152 defines a shade for directing light from the LED module in a selected direction. As shown in the drawings, the ring 152 has a substantially circular shape with an outer edge 154, an upper lip 156, a central lip 157, and a lower lip 158 for coupling the lens body 118 to the body 62. The ring 152 includes an arcuate shaped portion 160 that conforms substantially to the shape of the lens body 118 and has a second portion 162 with a length to extend from the lens 126 a distance sufficient to guide and focus the light emitted from the LED module. As shown, the shade portion 162 is angled slightly outward from the plane of the portion 160.

While various embodiments have been chosen to illustrate the invention, it will be understood by those skilled in the art that various changes and modifications can be made without departing from the spirit and scope of the invention as defined in the appended claims.

What is claimed is:

1. An LED module comprising:

a one-piece body member made from a heat conducting material, said body having a circular outer edge adapted for mounting in a support, a top side and a bottom side, a plurality of heat conducting fins extending from said top side and a mounting surface on a bottom side, said mounting surface being inclined with respect to a plane of said bottom side of said body; and an LED assembly fixed to said inclined mounting surface for directing light at an incline with respect to said plane of said bottom side, wherein said body member has, a center axis and is adapted for mounting in a lighting assembly and rotatably adjusting said body member about said center axis of said body member and with respect to said lighting assembly, and a first member extending from the top side of said body member for mating with a hole in a mounting assembly of a luminaire housing and enabling rotation of said LED module about said center axis with respect to the lighting assembly; and a second member extending from the top side of said body member adapted for mating with a registration hole of the mounting assembly to prevent rotation of said LED module with respect to said lighting assembly.

2. The LED module of claim 1, wherein said LED assembly further comprises, a first electrical connector coupled to said body member, and a second electrical connector adapted for coupling with a first electrical connector to a second LED module to form an LED array.

3. The LED module of claim 1, further comprising, a lens body coupled to said bottom side of said module for directing light from said LED assembly in a direction substantially perpendicular to said mounting surface.

4. The LED module of claim 1, further comprising, a lens body coupled to said bottom side of said body member, said lens body having a lens aligned with said LED assembly for focusing light from said LED assembly.

5. The LED module of claim 1, wherein, said bottom side of said body member has a recess, and where said mounting surface is formed within said recess.

6. An LED module comprising:

a one-piece body member made from a heat conducting material, said body having a circular outer edge adapted for mounting in a support, a top side and a bottom side, a plurality of heat conducting fins extending from said top side and a mounting surface on a bottom side, said mounting surface being inclined with respect to a plane of said bottom side of said body;

an LED assembly fixed to said inclined mounting surface for directing light at an incline with respect to said plane of said bottom side; and a recess in said top surface, and said first electrical connector mounted in said recess, said first electrical connector being operatively connected to said LED assembly, wherein said LED assembly further comprises, a first electrical connector coupled to said body member, and a second electrical connector adapted for coupling with a first electrical connector to a second LED module to form an LED array.

7. The LED module of claim 6, wherein, said LED assembly is fixed to said mounting surface by a thermally conducting adhesive.

8. The LED module of claim 1, wherein, said body member has a concave portion in said bottom side defining a recess, said recess having a first surface inclined with respect to said plane of said bottom side for defining said inclined mounting surface and a second inclined surface extending substantially perpendicular to said mounting surface and adapted for directing light from said LED along an axis substantially perpendicular to said mounting surface.

9. The LED module of claim 8, further comprising, a lens body having a convex portion received in said concave portion of said body member, said lens body having a lens aligned with said LED assembly in a plane substantially parallel to said mounting surface for focusing light from said LED assembly at an incline with respect to said plane of said bottom side.

10. The LED module of claim 9, wherein, said lens body has a shape complementing the shape of said bottom side of said body member and has an outer edge mating with and coupled to an outer edge of said body member.

11. A luminaire comprising:

a housing having a mounting assembly including a bottom wall having an opening receiving a plurality of LED modules, and a top wall overlying said LED modules and coupled to said bottom wall and capturing said LED modules therebetween, said LED modules being rotatable with respect to said top wall and bottom wall;

said LED modules coupled to said mounting assembly, each of said LED modules being independently positionable with respect to said luminaire to direct light in a selected target area with respect to a respective LED module, each said LED module comprising, a heat conducting body member having a circular outer edge, a top side with a plurality of heat conducting fins and a bottom side having an inclined mounting surface, said mounting surface being oriented at an incline with respect to a plane of said bottom side of said body member, said outer edge of said circular outer edge being coupled to said mounting assembly of said housing for rotatable adjustment in said housing, a first member extending from the top side of said body for mating with a first opening in said top wall of said mounting assembly of the housing to enable rotational adjustment of said LED module with respect to said housing, a second member extending from the top side of the body for registration with a registration hole in said top wall of said mounting assembly for fixing the orientation of said LED module, and an LED assembly coupled to said inclined mounting surface for directing light to said selected target area at an incline with respect to the plane of the body member and with respect to a plane of a bottom side of said housing.

12. The luminaire of claim 11, wherein, each said LED module is independently rotatable in said housing with respect to said mounting surface about an axis substantially perpendicular to a plane of said mounting surface.

13. The luminaire of claim 11, further comprising, a lens body coupled to said bottom side of said module for directing light from said LED assembly to said selected target area.

14. The luminaire of claim 11, wherein each said LED assembly further comprises, a first electrical connector coupled to a top side of said body member, and a second electrical connector coupled to a first electrical connector of a second LED module for connecting said LED modules in series.

15. The luminaire of claim 11, wherein, at least a portion of said first member of said body member extends through said opening in said top wall.

16. The luminaire of claim 11, wherein said body member has a concave recess in said bottom side, said recess having said mounting surface formed therein and a second surface oriented in a plane substantially perpendicular to said mounting surface.

17. The luminaire of claim 16, said modules further comprising a lens body coupled to said bottom side of said body member, said lens body having a convex portion received in said concave recess of said body member, said lens body having a light-transmitting lens portion oriented in a plane substantially parallel to said mounting surface and overlying said LED assembly for directing light from said LED assembly along an axis substantially perpendicular to said mounting surface and at an incline with respect to said bottom side of said body member.

18. The luminaire of claim 17, wherein said LED modules further comprise a shade coupled to said bottom side of said LED module and overlying said lens body, said shade having an opening aligned with said light-transmitting portion.

19. The luminaire of claim 17, wherein said light-transmitting lens portion includes a body with a rear face having a recess for receiving said LED assembly and a front face having a prism for directing light to the target area.

20. A luminaire comprising:

a housing having a bottom wall with an opening therein;

a mounting assembly in said housing, said mounting assembly having a plurality of spaced-apart openings;

a plurality of LED modules respectively associated with each opening in said mounting assembly and coupled to said mounting assembly and being adapted for directing light through said opening in said mounting assembly to a target area to be illuminated, each of said LED modules having a body member with an outer side edge coupled to said mounting assembly and having at least one LED assembly for directing light at an incline with respect to a plane of said bottom wall of said housing, each of said LED modules having a central axis perpendicular to the plane of said bottom wall and being rotatably adjustable with respect to said central axis and said bottom wall independent of each other to direct light from each LED module to a selected location of said target area.

21. The luminaire of claim 20, wherein, said mounting assembly has a base with said plurality of openings formed therein and a top plate with a plurality of openings aligned with said openings in said base, and where said LED modules rotatably received in said openings between said base and top plate.

22. The luminaire of claim 20, wherein, said LED is oriented to project light at an incline with respect to said central axis.

23. The luminaire of claim 22, wherein, each of said LED modules has a bottom face with a recess formed therein and a mounting surface formed in said recess for supporting a respective LED at an incline with respect to a plane of said bottom face.

24. The luminaire of claim 23, wherein, said mounting surface is formed at an incline with respect to said central axis and where said LED assembly is fixed to said mounting surface.

25. The luminaire of claim 20, wherein, each of said LED modules has a top face with a plurality of cooling fins.

26. The luminaire of claim 25, wherein, said LED modules are captured between said top plate and said base, and being rotatably adjustable with respect to said top plate and base about said central axis.

27. The luminaire of claim 26, wherein said LED module further comprises, a center portion received in said opening in said top plate for enabling rotation of said LED module about said central axis; and a registration member received in a registration opening in said top plate for locking said module in a selected angular position with respect to said central axis.

28. The luminaire of claim 23, said LED module further comprising, a lens cover coupled to said bottom face, said lens cover having a convex portion received in said recess of said module, said convex portion having a light-transmitting portion aligned with said LED for directing light to said target area.

* * * * *